United States Patent [19]

Mouissie et al.

[11] Patent Number: 4,715,825

[45] Date of Patent: Dec. 29, 1987

[54] CONNECTOR WITH PIERCE CONTACT ELEMENT HAVING REDUCED WEAR CROWN

[75] Inventors: Bob Mouissie, Ek Berlicum; Hubertus B. Libregts, Xr Vlijmen, both of Netherlands

[73] Assignee: E. I. Du Pont de Nemours and Company, Wilmington, Del.

[21] Appl. No.: 31,148

[22] Filed: Mar. 25, 1987

Related U.S. Application Data

[63] Continuation of Ser. No. 793,131, Oct. 30, 1985, abandoned.

[30] Foreign Application Priority Data

Nov. 9, 1984 [NL] Netherlands ..... 8403432

[51] Int. Cl.[4] ..... H01R 4/24

[52] U.S. Cl. ..... 439/391; 439/427

[58] Field of Search ..... 439/391–393, 439/417, 426, 427

[56] References Cited

U.S. PATENT DOCUMENTS

| | | | |
|---|---|---|---|
| 2,956,260 | 10/1960 | Bennett | 339/176 |
| 3,141,923 | 7/1964 | Henschke et al. | 174/59 |
| 3,860,316 | 1/1975 | Hardesty | 339/91 |
| 4,026,625 | 5/1977 | Roiko et al. | 339/99 |
| 4,054,350 | 10/1977 | Hardesty | 339/99 R |
| 4,428,636 | 1/1984 | Kam et al. | 339/97 P |
| 4,506,944 | 3/1985 | Brennan et al. | 339/99 R |

FOREIGN PATENT DOCUMENTS

| | | | |
|---|---|---|---|
| 0131705 | 9/1985 | European Pat. Off. . | |
| 888206 | 8/1953 | France . | |
| 1221836 | 1/1960 | France . | |
| 431557 | 7/1935 | United Kingdom | 339/100 |

*Primary Examiner*—Joseph H. McGlynn

[57] ABSTRACT

A pierce contact element for a connector with a housing in which the end of a cable with one or more insulated conductors is inserted. The pierce contact has a pointed part intended to pierce into an insulated conductor and a contact crown intended to make contact with the contact strip or contact wire of a matching connector housing. The contact crown is shaped so that its radius of curvature is larger than half the width of the contact crown in order to reduce wear on the surface contacting the strip or wire of the matching connector. In one embodiment, pierce contact is designed so that its pointed part pierces in the longitudinal direction into the end face of the conductor.

6 Claims, 7 Drawing Figures

CONNECTOR WITH PIERCE CONTACT ELEMENT HAVING REDUCED WEAR CROWN

This application is a continuation of application Ser. No. 793,131, filed 10/30/85, now abandoned.

BACKGROUND OF THE INVENTION

1. Field of Invention

The invention relates to a pierce contact element for a connector, and particularly to the shape of the element.

2. Description of Related Art

Connectors with a pierce contact element are provided with a housing in which the end of a cable consisting of a number of insulted conductors can be inserted and clamped in such a way that the pierce contact element can be driven into each of the insulated conductors. The pierce contact element commonly has a substantially flat body with a pointed part intended for piercing through the insulation of an insulated conductor into the actual conductor. It also includes a contact crown projecting outside the housing in the assembled state and intended to make contact with one of a number of contact strips or contact wires in a matching connector housing.

Such a pierce contact element is, for example, described in British Pat. No. 1,445,270.

The application of such pierce contact elements may lead to all kinds of problems, reducing the reliability of the connections achieved with such pierce contact elements and/or shortening the practical service life of the connections.

In the first place, problems can occur at the contact point(s) between the conductor and the pointed part(s) of the pierce contact element pierced into it. A slight movement between the conductor and a pointed part can already cause clearance, as a result of which the contact is adversely affected at that spot. It is also possible that the conductor may break during or after piercing a pointed part into it, which greatly impairs the contact, if any contact is made at all in that case.

Further problems can arise at the contact point between the projecting contact crown and the contact strip or contact wire which has to make contact with it. The projecting contact crown of this known element is provided with a top face which is rounded at both ends, and in fact the rounded front end of the contact crown forms the actual contact surface. The radius of curvature of this end is relatively small. The result is that the contact point between the contact wire or contact strip and the rounded contact surface during plugging of the connector into the matching connector is shifted only over a very short distance. All wear occurring, especially in the gold coating which is applied to the contact surfaces, is therefore concentrated within this above-mentioned very short distance. The part of the contact surface concerned will therefore be subjected to heavy wear, which reduces the service life of the contact element.

SUMMARY OF THE INVENTION

The object of the present invention is to reduce this exceesive wear considerably, so that a reliable contact is ensured at the various contact points and, in general, to extend the service life of the element considerably.

The invention is based on the idea that the shape of the pierce contact must be changed. The distance travelled by the contact point between the contact wire or strip and the contact surface during plugging of the connector into the matching connector must be increased considerably, because then the wear on the contact surface is spread over a larger area. In accordance therewith, the invention provides a pierce contact element of the type described above, which according to the invention is characterized in that the contact crown is provided with a contact surface which comes into contact with the contact strip or contact wire and is curved according to a radius of curvature which is larger than half the width of the contact crown.

In a preferred embodiment of the pierce contact element according to the invention, the radius of curvature is chosen in such a way that the distance over which the contact point travels is approximately the same as the width of the contact crown. This achieves maximum utilization of the available contact surface and minimum wear on this surface.

Moreover, the position of the pointed part(s) pierced into the conductor must be changed in such a way that the chance of a bad contact or break in the conductor is greatly reduced. In accordance therewith the invention now provides a pierce contact element of the type mentioned in the preamble, which according to the invention is characterized in that the flat body is provided with a pointed part which is intended for piercing in the longitudinal direction into the head end face of the conductor. This avoids a break in the conductor at the location where the pointed part is pierced into the conductor, and one achieves a contact junction which ensures a good contact even if there is an unexpected slight movement between the plug contact element and the conductor.

The base width of the pointed part is preferably smaller than the diameter of the conductor. This achieves a maximum contact face between the pointed part and the conductor. Through the more or less needle-shaped form acquired by the pointed part in this case, one also obtains relatively great insensitivity to mutual movements between the pointed part and the conductor.

In another preferred embodiment the flat body is also provided with two arms whose inside edges run parallel to and at a distance from the center line of the pointed part, and the distance between the two inside edges is adjusted to the dimensions of that part of the connector housing which is gripped by the edges. The effect thereof is that the relative movements between the conductor and the pierce contact element are practically eliminated, while good fixing of the pointed part is achieved in the center of the conductor.

BRIEF DESCRIPTION OF THE DRAWINGS

The invention will be described in greater detail below with reference to the attached drawings.

DESCRIPTION OF THE PREFERRED EMBODIMENTS

Figure 1:
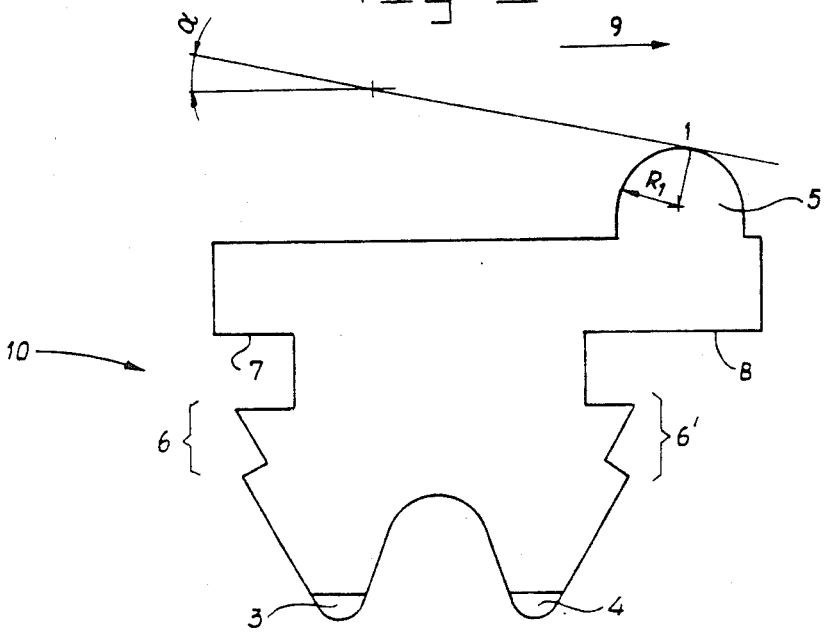
FIGS. 1 and 2 show a pierce contact element with a contact crown according to the state of the art.
Figure 2:
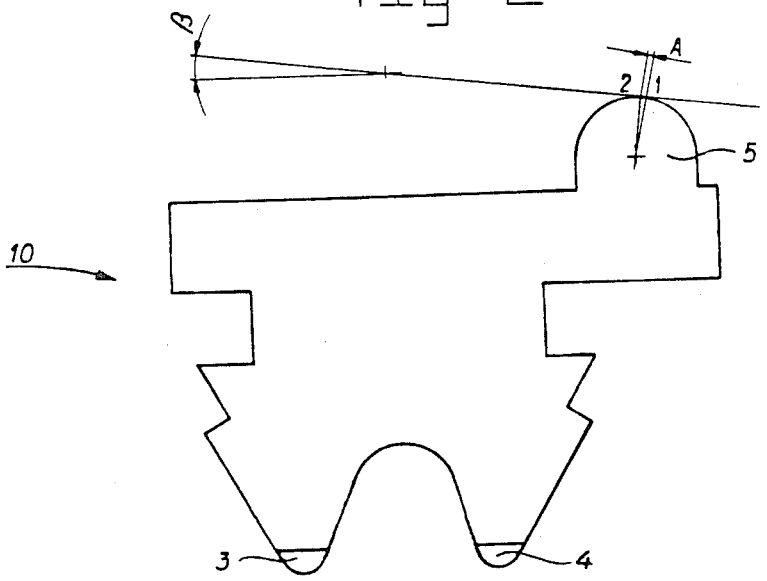

FIGS. 1 and 2 show a pierce contact element known from the state of the art. This pierce contact element consists of an esentially flat body having on the bottom side in this case two pointed contact tangs 3 and 4, which are intended to be pierced through the insulation of an insulated conductor into the actual conductor. During the piercing movement, the teeth 6' and 6, which engage with the material of the connector housing, serve to lock the pierce contact element. The ends of the edges 7 and 8 come to rest against the housing of the connector during pressing in of the pierce contact element and thereby determine the total piercing depth. At the top side, the pierce contact element body is provided with a contact crown 5 intended to make contact with a contact strip or contact wire present in the housing of the matching connector.

FIG. 1 is a schematic illustration of the situation during piercing of the connector into the matching connector at the time when a contact wire (not shown in FIG. 1) makes contact for the first time with the contact crown 5. The contact wire runs sloping at an angle $\alpha$ to the direction of plugging in and makes contact with the contact crown 5 at point 1.

During further piercing in, the contact element 10 will move in the direction of the arrow 9 and thereby lift the end of the contact wire or contact strip until one achieves the situation which is schematically indicated in FIG. 2. The contact strip or contact wire now forms a smaller angle $\beta$ with the plug in directon and the contact point between the strip or wire and the contact crown 5 is shifted from point 1 to point 2. This means that during plugging in of the connector the contact point has shifted over a distance A between point 1 and point 2. This distance is relatively small and all wear of the contact surface occurs in this distance. The result is therefore excessive wear of this part A, which makes it necessary to apply a relatively thick gold coating in order to obtain a reasonable service life from the contact element.

The invention is based on the idea that for reducing the wear, at least the wear around the final contact point 2, it is necessary to increase the distance A. This distance is partly determined by the radius of curvature R1 of the rounded top side of the contact crown in FIGS. 1 and 2.

Figure 3:
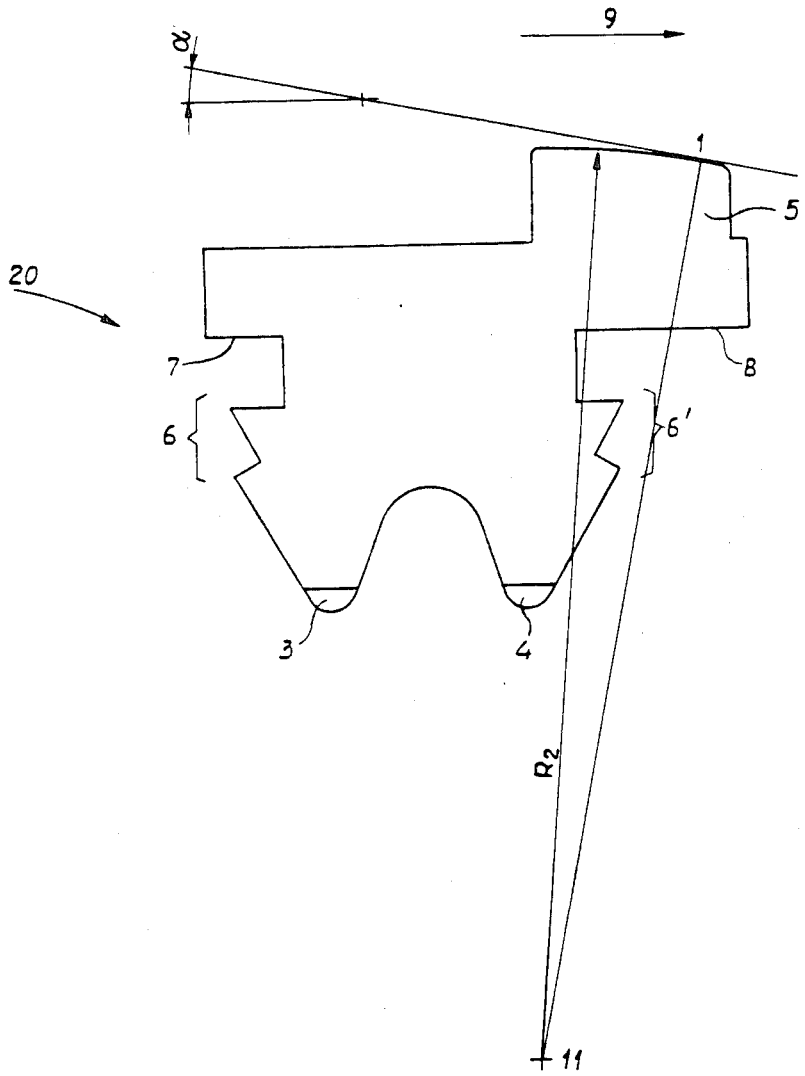
FIGS. 3 and 4 show a pierce contact element with a contact crown according to the invention.

FIG. 3 shows a contact element 20 according to the invention. The parts, which are identical to the parts shown in FIGS. 1 and 2 are indicated by the same reference numbers. As can be seen from FIG. 3, the only difference is found in the shape of the contact crown 5. This contact crown 5 now has a curved top edge which is curved according to a radius of curvature which is much greater than half the width of the contact crown. This radius is indicated in FIG. 3 by R2 going out from a far removed point 11.

During the plugging of the connector into the matching connector, one achieves the situation in which the contact wire or contact strip makes contact for the first time with the contact crown 5 at point 1 in FIG. 3. The angle between the contact strip or contact wire and the plug-in device 9 is again $\alpha$.

Figure 4:
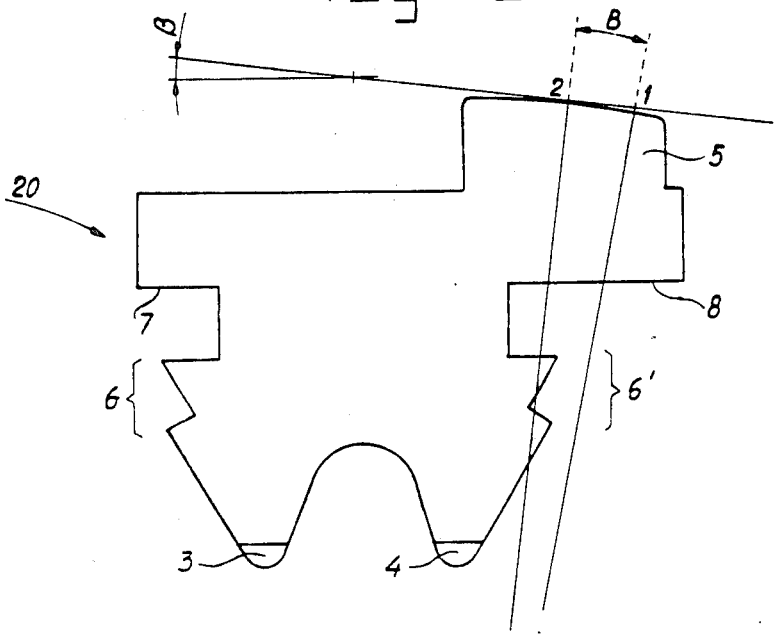

After a further plug-in movement, the final position illustrated in FIG.4 is achieved. The contact strip or contact wire now forms an angle $\beta$ with the contact element and the contact point between the contact strip or contact wire and the top surface of the contact crown 5 is shifted from point 1 to point 2. The distance between point 1 and point 2 is equal to B. As can be seen clearly from a comparison with FIG. 2, this distance B is much larger than the distance A, which is the result of choosing a radius of curvature R2 which is much larger than the radius of curvature R1, in particular larger than half the width of the contact crown.

Figure 5:
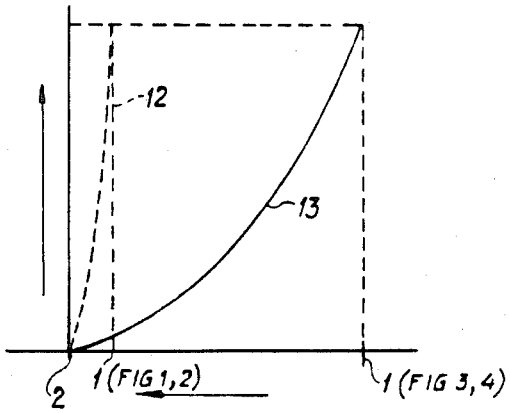
FIG. 5 is a graph illustrating the wear which occurs as a function of the distance which the contact point travels along the contact surface.

FIG. 5 is a graph of the amount of wear as a function of the contact point travel path. Plotted along the horizontal axis is the distance travelled from point 1 to point 2 by the contact point between the contact strip or contact wire and the top surface of the contact crown 5. The amount of wear is plotted along the vertical axis. As can be seen from FIG. 5, point 1 will be most subject to wear. The amount of wear thereafter decreases nonlinearly in the direction of point 2. In point 2 the wear is reduced to practically zero.

With the known contact crown illustrated in FIGS. 1 and 2, point 1 is close to point 2, which gives a steep wear curve, indicated by 12 in FIG. 5. If, however, according to the invention, the distance between points 1 and 2 is considerably increased, a much flatter wear curve 13 is obtained, and in particular the wear around the final contact point 2 is considerably reduced.

An optimum embodiment is achieved if the radius of curvature R2 is chosen in such a way that point 1 is located—at least as seen in FIG. 4—near the righthand side edge of the contact crown 5, and point 2 is near the lefthand side edge of the contact crown 5. In that case the maximum distance B is achieved and one obtains a wear curve which near point 2 runs practically horizontal, which indicates that the wear in the actual contact point is minimized.

Figure 6:
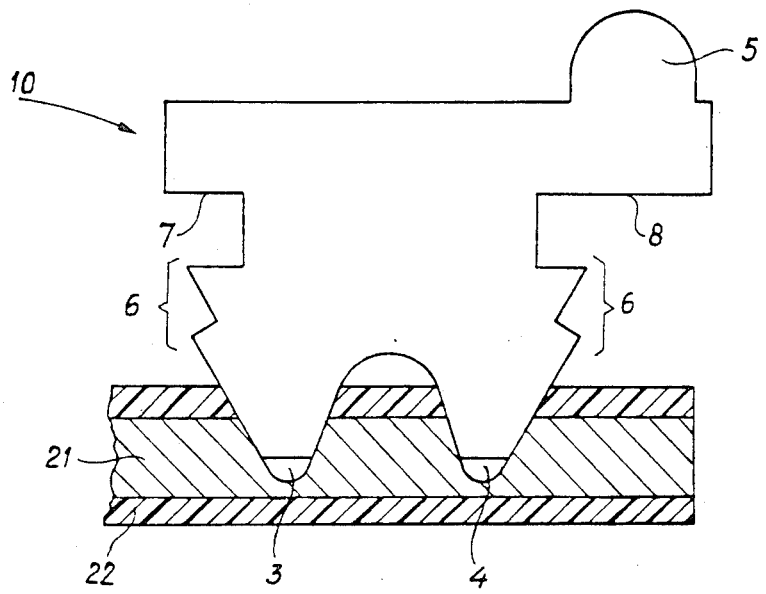
FIG. 6 shows the embodiment of FIG. 1 connected to a conductor.

FIG. 6 shows a pierce contact element 10 from the state of the art, plugged into an end of a cable consisting of the conductor 21 enclosed by the insulating sheath 22. The shape of this known plug contact element is the same as the shape shown in FIG. 1, and corresponding parts are indicated by the same reference figures.

It will be clear from FIG. 6 that there is a real danger that during piercing of the pierce contact element 10 into the actual conductor 21 a break will occur between the conductor parts on the left and right of the contact tang 3 or left and right of the contact tang 4. This risk of a break is further increased if one remembers that during use a tensile force can be exerted on the cable on the left side, and if a break does occur, there is always the danger that because of the tensile force exerted on the cable, clearance will occur between the contact tangs 3 and 4 and the cable 21, which impairs the contact between the two.

Figure 7:
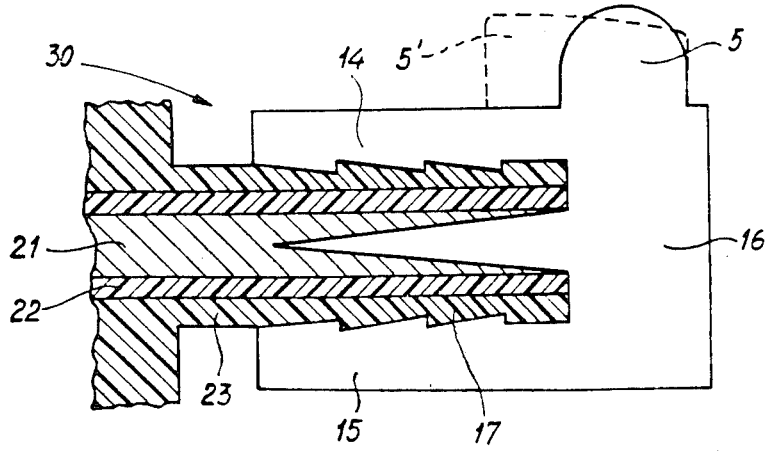
FIG. 7 shows another embodiment.

FIG. 7 illustrates a further embodiment of a pierce contact element according to the invention, where these problems are eliminated. This pierce contact element is provided with a base part 16 from which projects a contact tang 17. As illustrated in FIG. 7, this contact tang 17 is intended for piercing into the head end face of the conductor 21. Projecting from the base part 16 on both sides of the contact tang 17 are also the arms 14 and 15, which are provided with teeth on the side facing the contact tang.

When the pierce contact element is being pierced into the end of the cable 21, these teeth will grip part of the connector housing, shown particularly as 23 in FIG. 7, and will there ensure a firm anchoring of the pierce contact element 30. The connector to be used with a pierce contact element according to FIG. 7 is provided with a housing having, in addition to the apertures running from a side wall to receive the insulated conductors, grooves running from the opposite side wall to receive each a pierce contact element which is pierced into the insulated conductor received from the other side.

The contact tang 17 has preferably the same length as the arms 14, 15 or is a little shorter. If the tang 17 is a little shorter, the front ends of the arms 14, 15 serve as guide faces during piercing of the contact element onto the cable.

It is also preferable for the width of the base of the contact tang 17, where the contact tang 17 projects from the base part 16, not to exceed the diameter of the conductor 21. This means that the side edges of the contact tang 17 come into contact with the conductor 21 over the whole length, which ensures good contact.

It will be clear from the above that an optimum pierce contact element is obtained in accordance with the object of the invention if in FIG. 7 the contact crown 5, which has a shape known from the state of the art, is replaced by a contact crown of the type illustrated in FIGS. 3 and 4. With such an embodiment, which is indicated by the dotted line in FIG. 7 and has the reference FIG. 5', the least possible wear and the most reliable possible contact are obtained at all transition points between the pierce contact element and the conductor and between the pierce contact element and the contact strips or contact wires in the matching connector housing.

We claim:

1. A connector for a cable having at least one insulated conductor wherein electrical connection with said conductor is made within the housing by axially piercing the end face of the conductor, said connector comprising:

a insulation housing with said insulated conductor inserted through an aperture in a sidewall of the housing, a pierce contact element inserted through an opposite sidewall of housing, said contact element including a base from which projects a pointed tang and two arms, one arm on either side of the pointed tang, both arms being provided with teeth along their inside edges, said inside edges running parallel to from the center line of the pointed tang and at a distance therefrom which is adjusted to the dimensions of the housing whereby when the pierce contact element is inserted into the housing, the pointed tang pierces axially into the end face of the conductor and the teeth of the arms penetrate into and grip portions of the connector housing surrounding the conductor which has been pierced axially by the tang, said contact element further including a contact crown projecting from said base, said contact crown adapted to electrically contact a contact strip or contacting wire in a matching connector.

2. A connector according to claim 1 wherein the contact crown has a contact surface along which said contact strip or contact wire of the matching connector contacts said crown during the mating of the connector with the matching connector, said contact surface being curved according to a radius of curvature which is at least several times larger than half the width of the contact crown.

3. A connector for a cable having a plurality of insulated conductors, each of said conductors being inserted within a housing of the connector and therein pierced and clamped by a pierce contact element so as to make electrical connection therewith, each said pierce contact element comprising a substantially flat, conductive body having at least one pointed part intended for piercing into said insulated conductor, and a contact crown which in the assembled state projects outside the connector housing and has a contact surface which is adapted to electrically contact a contact strip or contact wire in a mating connector, said contact strip or contact wire forming an angle with the plug-in direction of the connector into the mating connector, said angle changing as a result of the movement of the point of contact along the contact surface of the crown during insertion of the connector into the mating connector, the contact surface of said contact crown being curved according to a radius of curvature which is at least several times larger than half the width of the contact crown, whereby the contact point between said contact strip or contact wire of the mating connector and the curved contact surface of said contact crown moves along said curved contact surface during insertion of the connector into the mating connector a distance which is almost the same as the width as the contact crown, thereby minimizing the wear along the curved contact surface.

4. A connector according to claim 3 wherein the pointed part of said pierce contact element pierces laterally through an insulation jacket surrounding each conductor.

5. A connector according to claim 3 wherein the pointed part of said pierce contact element pierces axially into the end face of the conductor.

6. A connector according to claim 5 wherein said pierce contact element further comprises a base from which projects a pointed tang and two arms, one arm on either side of the pointed tang, both arms being provided with teeth along their inside edges, said inside edges running parallel to from the center one of the pointed tang and at a distance therefrom which is adjusted to the dimensions of the housing whereby when the pierce contact element is inserted into the housing, the pointed tang pierces axially into the end face of the conductor and the teeth of the arms penetrate into and grip lateral portions of the insulation surrounding the conductor which has been pierced axially by the tang.

* * * * *